US006029300A

United States Patent [19]

Kawaguchi et al.

[11] Patent Number: 6,029,300

[45] Date of Patent: Feb. 29, 2000

[54] SPIN EXTRACTOR

[75] Inventors: Tomonari Kawaguchi, Otsu; Kiyoyuki Suo, Koka-gun, both of Japan

[73] Assignee: Sanyo Electric Co., Ltd., Moriguchi, Japan

[21] Appl. No.: 09/144,087

[22] Filed: Aug. 31, 1998

[30] Foreign Application Priority Data

Sep. 10, 1997 [JP] Japan ..... 9-264872

[51] Int. Cl.[7] ..... D06F 33/02

[52] U.S. Cl. ..... 8/159; 68/12.06; 68/12.14; 68/12.16

[58] Field of Search ..... 68/12.06, 12.14, 68/12.16; 34/58, 319; 8/159

[56] References Cited

U.S. PATENT DOCUMENTS

| | | | |
|---|---|---|---|
| 4,853,605 | 8/1989 | Matsuo et al. | 68/12.16 X |
| 5,181,398 | 1/1993 | Tanaka et al. | 68/12.14 X |
| 5,301,522 | 4/1994 | Ikemizu et al. | 68/12.06 |
| 5,325,677 | 7/1994 | Payne et al. | 68/12.14 X |
| 5,692,313 | 12/1997 | Ikeda et al. | 68/12.06 X |
| 5,765,402 | 6/1998 | Ikeda et la. | 68/12.06 |
| 5,893,280 | 4/1999 | Honda et al. | 68/12.06 |

FOREIGN PATENT DOCUMENTS 6-254294 9/1994 Japan .

*Primary Examiner*—Philip R. Coe
*Attorney, Agent, or Firm*—Oliff & Berridge, PLC

[57] ABSTRACT

In an inventive spin extractor, a speed controller applies a constant voltage to a motor for starting a rotation of a drum. Since the torque on the drum is constant, the drum rotates at a low speed when the laundry is in the form of a large mass and the load on the drum is accordingly large. Every time part or all of the laundry falls beyond the baffles provided on the inner peripheral wall of the drum, the laundry is loosened and scattered, so that the load on the drum decreases. When the laundry is scattered adequately, the torque by the motor overcomes the load of the laundry, and the drum speed rapidly rises. When the speed exceeds the equilibrium speed where the centrifugal force acting on the laundry is equal to gravity, the scattered laundry starts rotating in the state of being pressed on the inner peripheral wall of the drum. When the drum speed reaches a preset speed higher than the equilibrium speed, the speed controller changes the speed control method to a phase control method for maintaining the drum speed at an object speed. While the drum is rotating at the object speed, the eccentric load detector detects the magnitude of the eccentric load based on the periodical change in the motor current, and a central controller determines whether the laundry is distributed evenly on the inner peripheral wall of the drum.

17 Claims, 8 Drawing Sheets

Fig. 3
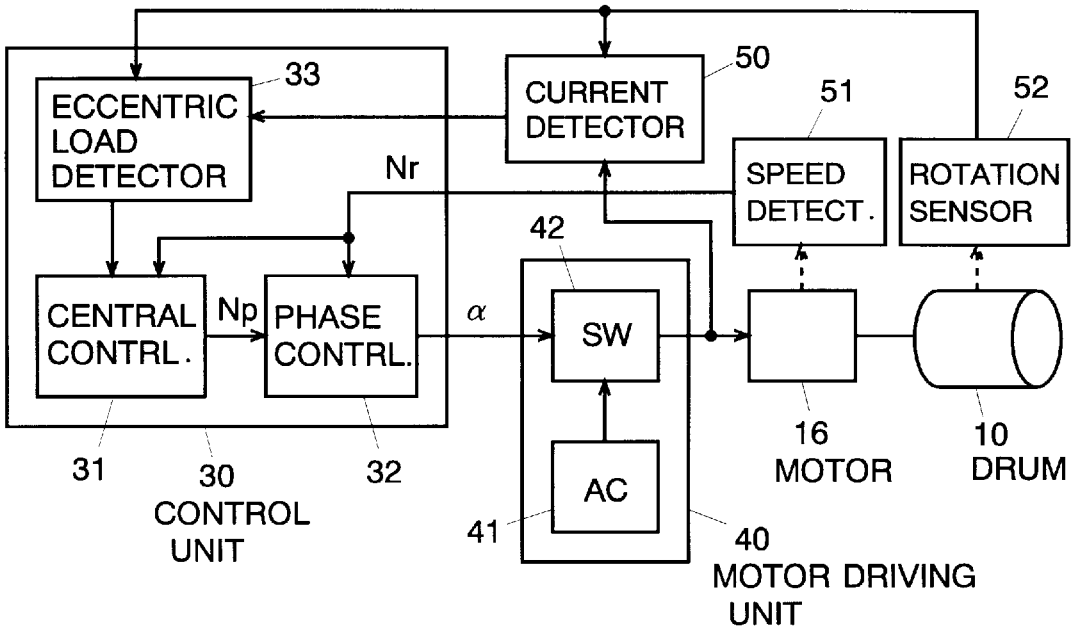
Fig. 4A
Fig. 4B
Fig. 4C
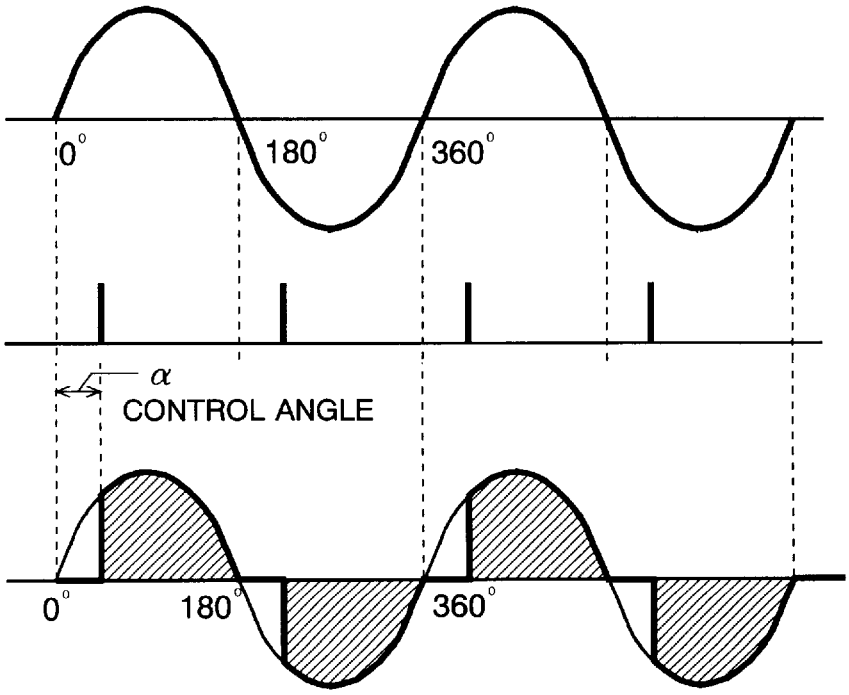

BEFORE STARTING DRUM ROTATION

INITIAL STAGE OF ROTATION (LOAD STILL LARGE)

INITIAL STAGE OF ROTATION (LOAD BEING SMALLER)

INITIAL STAGE OF ROTATION (LAUNDRY BEING SCATTERED)

DURING ROTATION WITH CENTRIFUGAL FORCE LARGER THAN GRAVITY

BEFORE STARTING DRUM ROTATION

INITIAL STAGE OF ROTATION (LOAD STILL LARGE)

INITIAL STAGE OF ROTATION (LOAD BEING SMALLER)

DURING ROTATION WITH CENTRIFUGAL FORCE LARGER THAN GRAVITY

SPIN EXTRACTOR

The present invention relates to a spin extractor for extracting liquid such as water or dry cleaning solvent from the laundry by rotating a basket drum with the laundry loaded therein about a horizontal axis at high speed. The spin extractor according to the present invention can be used as a part of a washing machine whereby washing and extraction are carried out continuously, or of a washing/drying machine whereby washing, extraction and drying are carried out continuously.

BACKGROUND OF THE INVENTION

A so-called drum type or front loading type of spin extractor is constituted so that the laundry is loaded in a basket drum having a horizontal rotation axis, and that the drum is rotated about the axis at high speed. One of the serious problems with this type of spin extractor is that, when the drum is rotated at high speed with the laundry distributed unevenly on its peripheral wall, abnormal vibration or noise occurs due to the unbalance in mass distribution around the central axis of the drum. For suppressing such vibration or noise, some of the conventional washing/drying machines having the above type of spin extractor have one or several weight pieces attached to an outer tub in which the drum is mounted. This type of washing/drying machine, however, is very heavy and large, so that it is difficult to move or transport it, and its installation is limited.

Some proposals have been made addressing this kind of abnormal vibration or noise of the drum type spin extractor. For example, the Publication No. H6-254294 of the Japanese Unexamined Patent Application discloses a spin extractor wherein the drum is rotated at low speeds for redistributing the laundry on the inner peripheral wall of the drum before the drum is rotated at a high speed for liquid extraction. In detail, the speed of the drum is controlled by a two-stage balancing operation including steps of rotating the drum at a first low speed for a short time and then rotating the drum at a second low speed that is a little higher than the first low speed and much lower than the high speed for extraction.

In addition, the above spin extractor has a vibration sensor on its base as a means for detecting the eccentric load due to an uneven distribution of the laundry in the drum. When the vibration sensor detects abnormal vibration during the rotation of the drum at high speed, the drum speed is reduced.

By the above-described method of controlling the drum speed, however, it is not assured that the laundry is redistributed evenly on the inner peripheral wall of the drum by a single cycle of the two-stage balancing operation. Therefore, the balancing operation often becomes a trial and error process including steps of rotating the drum at the low speeds for correcting the balance, raising the drum speed to the high speed for extraction and, responsive to a detection of abnormal vibration, reducing the drum speed to rotate the drum at the low speeds again. If such a trial and error process occurs, the time required for the extraction becomes very long.

Besides, none of the conventionally proposed methods of correcting the balance of the laundry effectively works when only one or a few large articles, such as a bed sheet, are loaded in the drum, because this type of article is hard to loosen when it retains water and forms a larger mass.

SUMMARY OF THE INVENTION

For solving the above-described problems, the main object of the present invention is to propose a spin extractor wherein the reliability of obtaining an even distribution of the laundry is improved so that the balance correction process is completed within a short time period.

Thus, the present invention proposes a spin extractor for extracting liquid from a laundry by rotating a basket drum with the laundry located therein about a horizontal axis, which includes a motor for rotating the basket drum, a speed detector for detecting a speed of the motor, and a speed controller for applying a constant voltage to the motor so that the basket drum is rotated at a constant torque and the laundry loaded in the basket drum is redistributed on an inner peripheral wall of the basket drum in an initial stage of a liquid extracting operation until a speed of the basket drum reaches a preset speed higher than an equilibrium speed at which a centrifugal force acting on the laundry in the basket drum is equal to gravity, and for controlling the motor so that an actual speed of the motor detected by the speed detector is maintained at an object speed after the speed of the basket drum reaches the present speed.

In the spin extractor according to the present invention, the speed controller applies a constant voltage to the motor for starting the drum to rotate with the laundry loaded therein. By this method, the drum speed changes in the initial stage of the drum rotation. That is, when the laundry is being lifted by one or more of baffles provided projecting on the inner peripheral wall of the drum, the load on the drum is large, and when all or part of the laundry falls beyond the baffle, the load on the drum decreases rapidly. According to such a change in the load on the drum, the drum speed also changes. Here, when the drum is rotated by an appropriate constant torque, the drum speed does not exceed a specific speed in the initial stage of the rotation where the laundry is in the form of a large mass and the load of the laundry is accordingly large. As the drum rotation proceeds, the laundry is gradually loosened and redistributed on the inner peripheral wall of the drum, so that the load on the drum decreases. When the load decreases to a certain level, the torque generated by the motor overcomes the load of the laundry, at which time the drum speed rapidly rises and then exceeds an equilibrium speed at which the centrifugal force acting on the laundry is equal to gravity. When drum speed reaches a preset object speed higher than the equilibrium speed, the speed controller changes the speed control method to such a method where the drum speed is maintained at the object speed.

By the above-described method of starting the drum rotation, the mass of the laundry is loosened by the baffles, so that the laundry is easily redistributed on the inner peripheral wall of the drum and the magnitude of the eccentric load becomes smaller.

When the load on the motor changes, the driving current in the motor contains an alternating torque component. So, when the laundry is unevenly distributed on the inner peripheral wall of the drum, the driving current of the motor changes according to the change in the load while the drum is rotated with the laundry pressed on its inner peripheral wall by centrifugal force.

Thus, in a preferable mode of the invention, the spin extractor further includes: an eccentric load detector for detecting the magnitude of the eccentric load due to the uneven distribution of the laundry based on the change in the driving current supplied to the motor while the drum is rotated at a speed higher than the equilibrium speed; and an eccentric load determiner for determining whether the magnitude of the eccentric load is greater than a preset value, and the speed controller is constituted to stop the drum temporarily and then to start the drum rotation again when the magnitude of the eccentric load is determined to be greater than a preset value.

By this constitution, the determination result obtained based on the change in the driving current supplied to the motor is used for estimating whether abnormal vibration of the drum or the outer tub occurs during high speed extraction. When the magnitude of the eccentric load is greater than the preset value, the drum is stopped temporarily and then the drum rotation is started again as described above, whereby the laundry is redistributed.

In the spin extractor according to the present invention, when the voltage applied to the motor is very high, or when the torque of the motor is very large, the drum speed rises rapidly, so that the laundry starts rotating in the state of being pressed on the inner peripheral wall of the drum by centrifugal force before it is adequately redistributed.

Therefore, in a preferable mode of the invention, the spin extractor further includes a timer for measuring a time period required for the drum speed to reach a preset speed when a first constant voltage is applied to the motor by the speed controller, and the speed controller is constituted to stop the drum temporarily and to start the drum rotation again by applying to the motor a constant voltage lower than the first constant voltage when the time period required thereby is shorter than a preset time period.

By this constitution, the time period measured by the timer is used for determining whether the torque of the motor is greater than an appropriate torque for the load of the laundry. When the time period measured by the timer is shorter than the preset time period, the speed controller determines that the torque of the motor is too large, and reduces the voltage applied to the motor to reduce the torque. By this speed control, the probability of the laundry's being redistributed in the drum becomes higher in the re-started drum rotation.

When, on the other hand, the voltage applied to the motor for starting the drum rotation is too low, or when the torque is too small, the drum does not rotate at all, or the drum stops in the course of the rotation even if it once starts rotating. Therefore, in a preferable mode of the invention, the spin extractor includes a lapse timer for measuring the lapse of time from the start of the application of the constant voltage to the motor, and the speed controller is constituted to increase the voltage applied to the motor when the lapse of time reaches a preset time period before the drum speed reaches a preset speed.

In a still more preferable mode, the speed controller is constituted to increase the voltage applied to the motor when the speed of the motor detected by the speed detector is zero while the constant voltage is applied to the motor.

In another mode of the present invention, the speed controller is constituted to control the speed of the motor by a phase control process wherein the driving current supplied to the motor is an alternating current cut off at a timing (or a phase angle, which is referred to as "a control angle" hereinafter) within each cycle of the alternating current, and the speed of the motor is controlled by changing the control angle. The process includes steps of maintaining the control angle until a preset speed is reached and determining the control angle based on the difference between the actual speed and an object speed after the preset speed is reached.

In still another mode of the present invention, the speed controller is constituted to control the speed of the motor by a pulse width modulation process wherein the driving current supplied to the motor is in a form of a series of pulses each having a preset duration (pulse width), and the speed of the motor is controlled by changing the pulse width. The process includes steps of maintaining the pulse width until a preset speed is reached and determining the pulse width based on the difference between the actual speed and an object speed after the preset speed is reached.

In the spin extractor according to the present invention, the baffles play an important role in the process of redistributing the laundry. So, it is preferable to provide an adequate number of baffles on the inner peripheral wall of the drum to improve the redistributing efficiency. For example, it is recommended to provide at least six baffles on the inner peripheral wall of the drum at every preset angular interval.

As explained above, in the spin extractor according to the present invention, at first the motor generates a constant torque while the drum speed increases from zero to a preset speed, and after the preset speed is reached, the motor is driven so that the actual speed of the motor detected by the speed detector is maintained at the object speed. In the initial stage of the drum rotation, the drum speed changes according to the change in the load on the drum that occurs when the laundry is moved in the drum by baffles as described above. When the laundry is scattered beyond the baffles and the load on the drum becomes adequately small, the speed of the drum increases rapidly, whereafter the drum starts rotating with the laundry pressed on its inner peripheral wall by centrifugal force. Thus redistributing the laundry on the inner peripheral wall of the drum, the load balance of the drum is corrected in a short time, and the high speed extraction is started promptly. Accordingly, the time required for extraction, and further the time required for the whole process including washing and extraction, are shortened.

In the inventive spin extractor, the laundry rolls over the baffles at a relatively low speed in the initial stage of the drum rotation. So, when one or few of large laundry articles, such as a bed sheet, are loaded in the drum in the form of a large mass with water retained therein, the laundry is gradually loosened and expanded every time it rolls over each of the baffles, whereby the balance is corrected adequately so that the magnitude of the eccentric load becomes adequately small.

BRIEF DESCRIPTION OF THE DRAWINGS

FIG. 3 is a block diagram showing the electrical system of the washing machine;

FIGS. 4A–4C are graphs showing an example of wave form for explaining the process of controlling the speed of the motor in the washing machine;

DETAILED DESCRIPTION OF A PREFERRED EMBODIMENT

Figure 1:
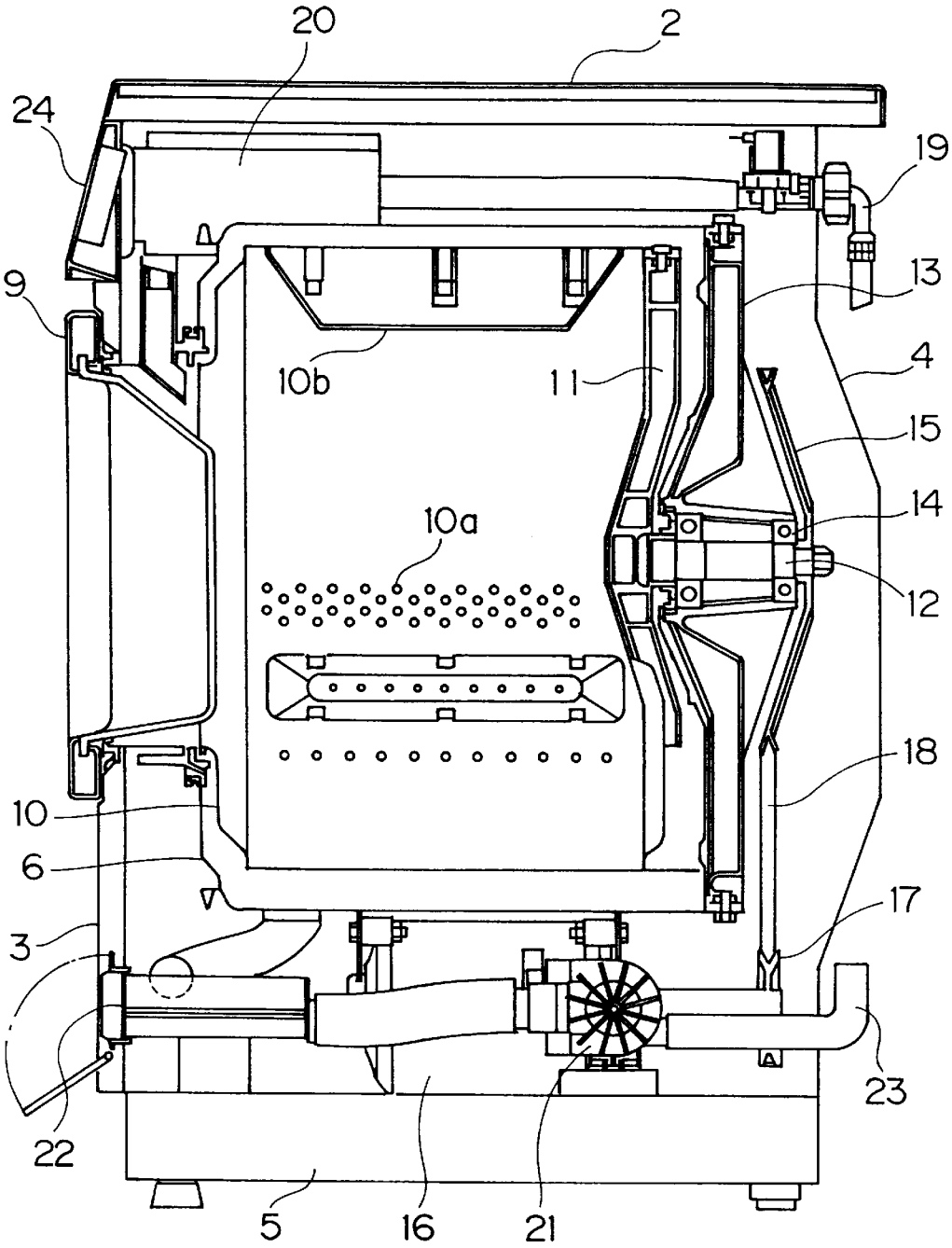
FIG. 1 is a side view of a drum type washing machine including a spin extractor embodying the present invention, wherein a side panel is removed.
Figure 2:
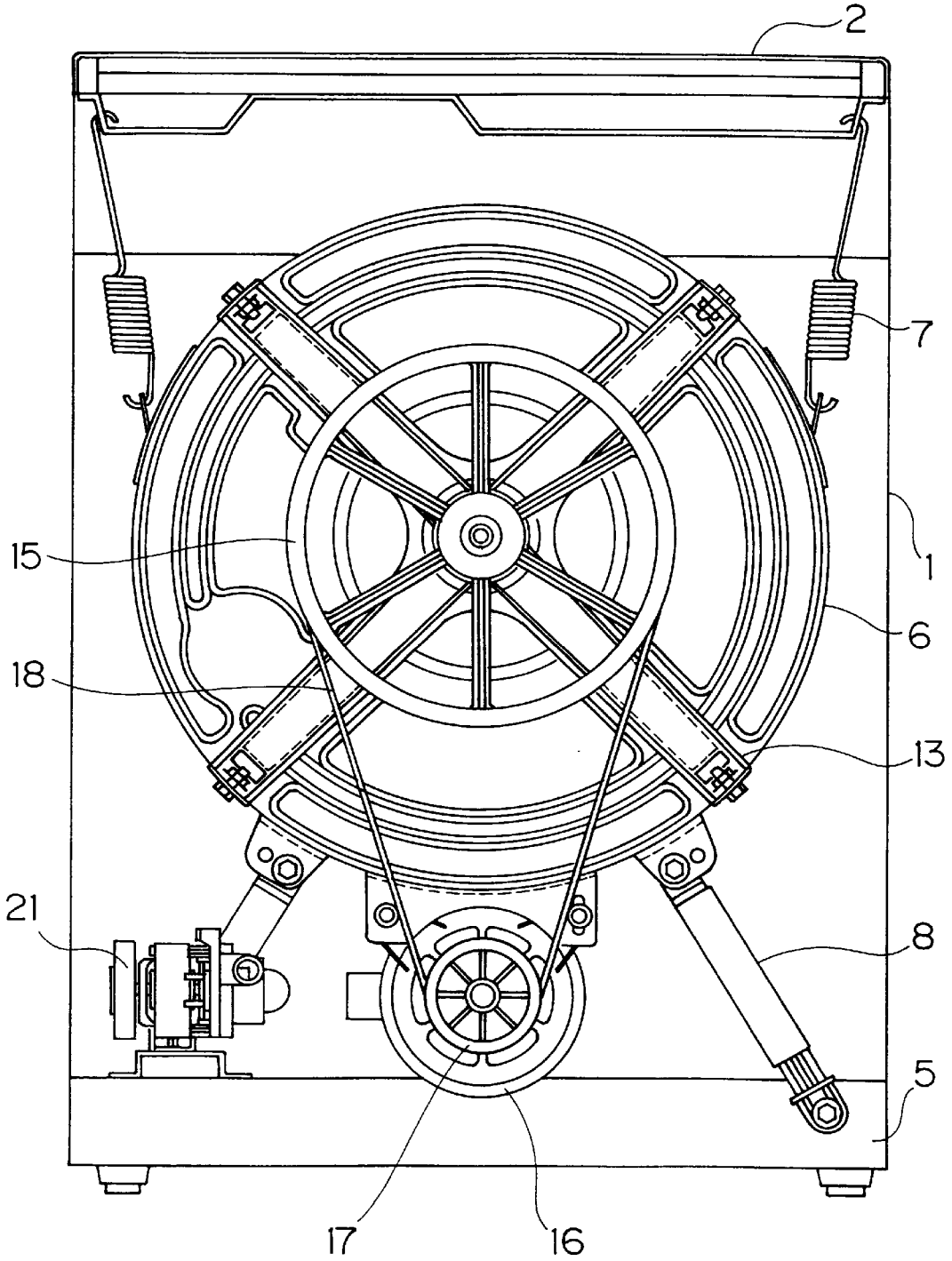
FIG. 2 is a rear view showing the main part of the machine, where a rear cover is removed.

A drum type washing machine including a spin extractor embodying the present invention is explained referring to FIGS. 1–9. First, the whole structure of the washing machine is described referring to FIGS. 1 and 2.

A body case is built up by a frame 1, a top plate 2, a front panel 3, a rear cover 4 and a base 5. In the body case, an outer tub 6 having a front opening is hung by springs 7 and sustained by dampers 8 for absorbing vibration. The front panel 3 has a door 9 for closing the front opening of the outer tub 6. The door 9 is opened when the user throws the laundry through the front opening of the outer tub 6 into a drum 10 provided in the outer tub 6. The drum 10 has a shaft holder 11 on its rear part, to which a main shaft 12 is securely attached. The main shaft 12 is born by a bearing structure 13 provided at the rear part of the outer tub 6. The bearing structure 13 includes a roller bearing 14 for rotatably holding the main shaft 12. An end of the main shaft 12 is protruding out from the rear part of the outer tub 6, and a large pulley 15 is fixed to the end. A motor 16 is disposed under the outer tub 6, and a small pulley 17 is fixed to the rotation axis of the motor 16. The small pulley 17 is drivingly connected with the large pulley 15 by a V-belt 18.

Water supplied from an outside source, such as a water tap, is introduced through a water supply hose 19 into a water supply unit 20. Though not shown, the water supply unit 20 has a water passage, a valve disposed in the water passage, and a detergent dispenser also disposed in the water passage. When water is introduced in the water passage, the detergent contained in the detergent dispenser eludes into the water, thus producing detergent water, and the detergent water is injected into the outer tub 6. The drum 10 has a number of perforations 10*a* formed in its peripheral wall, through which the water injected into the outer tub 6 enters the drum 10. The perforations 10*a* also function as water outlets during the extraction. That is, water extracted from the laundry during the extraction is centrifugally drained from the perforations 10*a* to the outside of the drum 10. On the inner peripheral wall of the drum 10 are disposed baffles 10*b* at every preset angular interval for lifting the laundry. The washing machine of the present embodiment is designed to have six baffles 10*b*, as shown in FIG. 8. It should be noted that the number of baffles may be other than six, preferably more than six. A drainage pump 21 is provided for draining water gathered at the bottom of the outer tub 6. The water drained from the outer tub 6 passes a lint filter 22, which can be taken out from the front end, and is discharged from a drainage hose 23 to the outside.

The configuration and operation of the electrical system of the main part of the above washing machine is described referring to FIG. 3. A control unit 30 consisting mainly of one or several micro-computers functionally includes a central controller 31, a phase controller 32, an eccentric load detector 33 and other functional units (not shown). The central controller 31 includes a memory (not shown) wherein operation programs for carrying out a washing process (including extracting operation) are stored beforehand. During the extracting operation, the central controller 31 receives signals or information relating to the magnitude and position of the eccentric load from the eccentric load detector 33, and processes the information by a method explained later to calculate an object speed Np corresponding to a desirable drum speed. The object speed Np is sent to the phase controller 32.

A motor driving unit 40 includes an alternating current source (AC) 41 and a switch (SW) 42. The motor driving unit 40 and the phase controller 32 function as a speed controller for controlling the speed of the motor 16. The motor 16 is equipped with a speed detector 51 consisting of a pulse generator and other elements. The speed detector 51 generates pulse signals indicative of the actual speed Nr of the motor 16. The pulse signals are sent to the phase controller 32 for a feedback control explained later.

Figure 5:
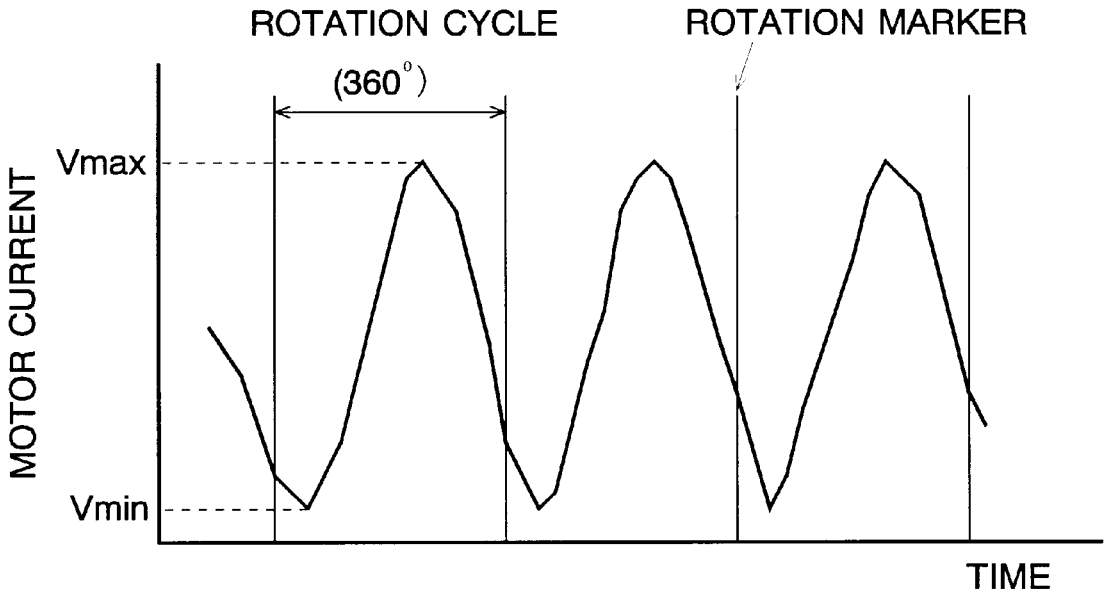
FIG. 5 is a graph showing an example of wave form of the motor current changing under the influence of the eccentric load.

A current detector 50 detects a driving current (motor current) supplied from the motor driving unit 40 to the motor 16, converts the current to a voltage, and sends the voltage signal to the eccentric load detector 33. FIG. 5 is a graph showing an example of waveform of the torque component in the motor current, changing according to the lapse of time. In FIG. 5, rotation markers are marker signals generated by a rotation sensor 52 provided to the drum 10, each rotation marker indicative of one rotation cycle of the drum 10. When an eccentric load exists in the drum 10, the torque component in the motor current periodically changes, as shown in FIG. 5, depending on the eccentric load. Since the change in the motor current corresponds to the change in the load torque, the maximum value Vmax of the torque component appears when the load torque is maximized in each rotation of the drum 10. The difference between the maximum value Vmax and the minimum value Vmin (amplitude of the current change) corresponds to the magnitude of the eccentric load. The relation between the amplitude of current change and the magnitude of the eccentric load is investigated beforehand, and the relation data is stored in the memory of the central controller 31 in the form of a table, for example. The relation table is used for calculating the magnitude of the eccentric load from an amplitude of current change.

In detail, the calculation is performed as follows. When an electric current having a waveform as shown in FIG. 5 is given, the eccentric load detector 33 detects the maximum value Vmax and the minimum value Vmin of the electric current for each interval of the rotation markers, i.e. for each rotation of the drum 10, and calculates the difference between the two values. The magnitude of the eccentric load is obtained from the differential value (amplitude of the current change) based on the relation table. Also, the position of the eccentric load on the inner peripheral wall of the drum 10 may be detected based on the timing of detecting the maximum value Vmax. The timing is represented by a delay time or angle from the nearest of the preceding rotation markers, for example.

The process of controlling the speed of the motor 16 is described in detail, referring to FIG. 4 and focusing on the operation of the phase controller 32 and the motor driving unit 40. The phase controller 32 determines a control angle $\alpha$[deg] based on the difference between the object speed Np and the actual speed Nr, and sends a signal indicative of the angle $\alpha$ to the switch 42. The switch 42 consists of a gate control type of semiconductor switch, such as a triac, and other elements, for example. The AC source 41 supplies to the switch 42 a sine wave alternating current of a single phase as shown in FIG. 4A, and the switch 42 turns the alternating current ON and OFF according to the control angle $\alpha$. In detail, a pulse signal is generated at a position delayed by the control angle $\alpha$ from each base position corresponding to phase angle 0[deg], as shown in FIG. 4B. The electric current is turned OFF during the angular interval from 0 to $\alpha$[deg], and is turned ON during the angular interval from $\alpha$ to 180[deg]. As a result, a series of current pulses are supplied intermittently to the motor 16 as the driving current, as indicated by the shaded areas in FIG. 4C. The driving current (or driving power) supplied to the motor 16 increases when the phase controller 32 sets the control angle $\alpha$ smaller, and vice versa.

Figure 6:
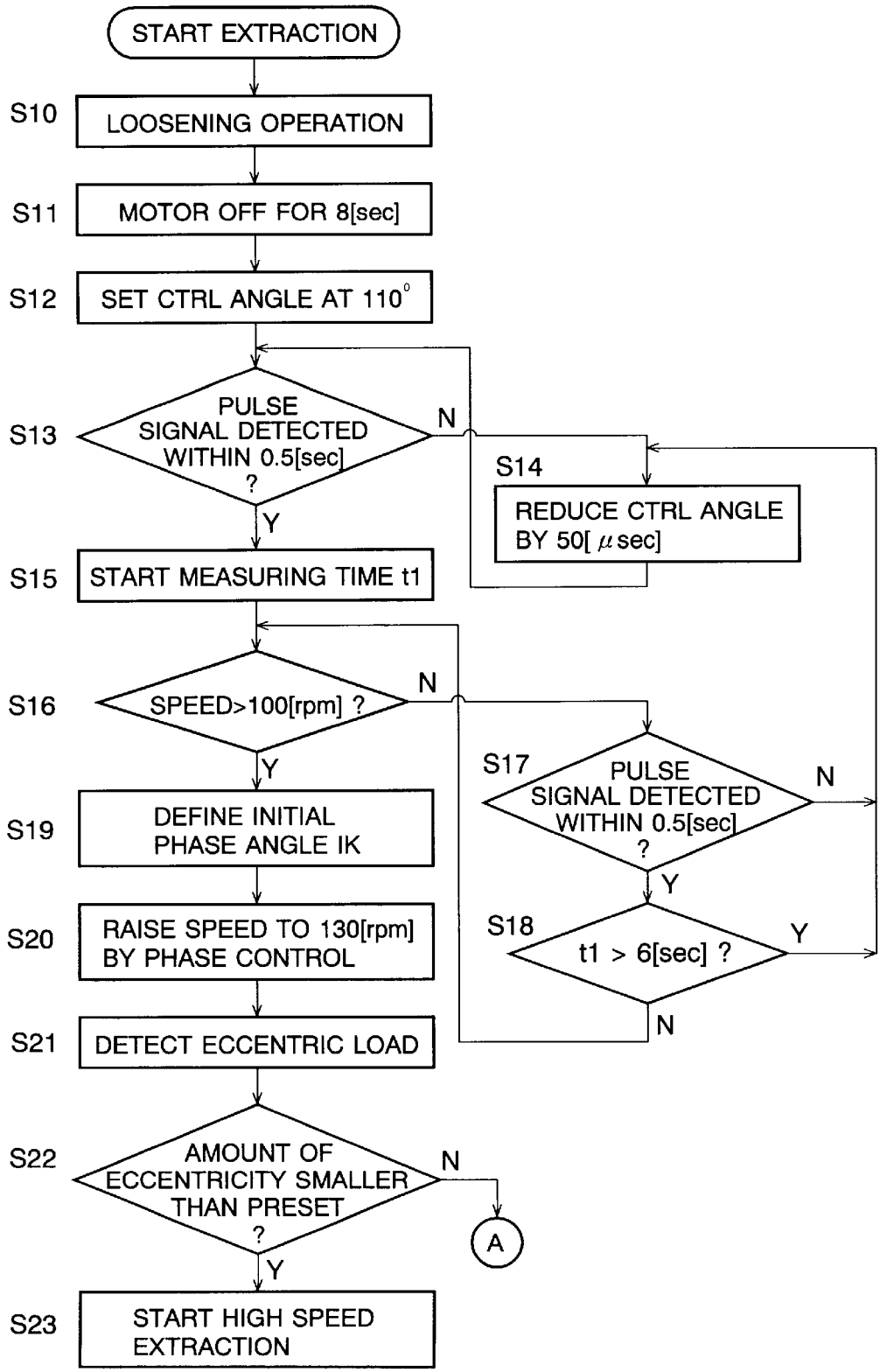
FIGS. 6 and 7 are flow charts showing the process of starting the drum rotation in the extracting operation.
Figure 7:
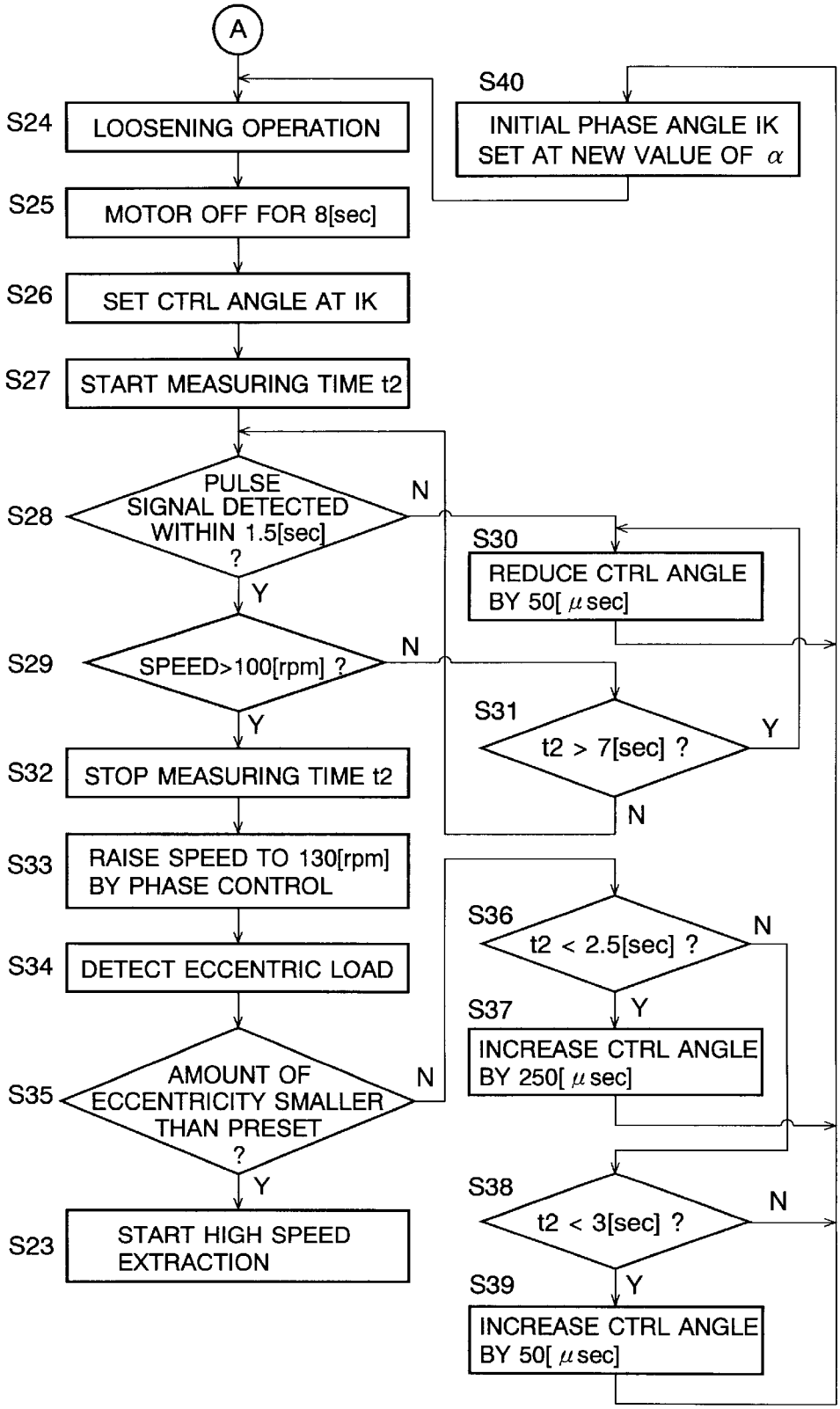

The process of controlling the drum speed in the initial stage of the extracting operation by the above washing machine is described referring to the flow charts of FIGS. 6 and 7. In the following description, values of various parameters are calculated under the condition that the diameter of the drum 10 is 470[mm]. It should be understood that the values are just illustrative, and the parameters may take different values when the diameter of the drum 10 is different.

After the completion of washing or rinsing, the laundry in the drum 10 are crammed and piled at the bottom of the drum 10. Therefore, the central controller 31 sends a loosening operation start signal to the phase controller 32 for starting a loosening operation (Step S10). In the loosening operation, the drum 10 is rotated back and forth at a speed of, for example, about 55[rpm]. By this operation, the laundry articles entangled together are loosened, so that it is now easier for the articles to separate.

After carrying out the loosening operation for a preset time, the driving current to the motor 16 is turned off for a preset time of, for example, 8[sec] (Step S11). The time is preset long enough for the drum 10 to stop completely during the time. After that, an initial phase angle IK is determined as follows. First, the central controller 31 sets the control angle α at 110[deg], and sends a signal indicative of the angle α to the phase controller 32, whereby a voltage corresponding to the control angle α is applied to the motor 16 (Step S12). The control angle α in Step S12 is preset to correspond to a low voltage for generating such a small torque that can rotate the drum 10 only when the amount of the laundry loaded in the drum 10 is very small.

After that, based on the output of the speed detector 51, the central controller 31 determines whether a pulse signal from the speed detector 51 is detected within 0.5[sec] after starting the application of the voltage to the motor 16 (Step S13). When no pulse signal is detected in Step S13, it means that the motor 16 is not rotating or that the torque of the motor 16 is not large enough to overcome the load of the laundry in the drum 10. Thus, when no pulse signal is detected, the control angle α is reduced by, for example, 50[μsec] or about 1[deg] in angle (Step S14), whereby the torque of the motor 16 also increases since the voltage applied to the motor 16 increases. Thus, while the determination result in Step S13 is "NO", the modification of the control angle α in Step S14 is repeated, and the torque of the motor 16 increases incrementally.

When it is determined in Step S13 that the pulse signal is detected within 0.5[sec], the central controller 31 starts measuring the lapse of time (t1) by a timer (Step S15). After t1 reaches a preset time period, the central controller 31 determines whether the speed of the drum 10 is higher than 100[rpm] (Step S16). By the washing machine of the present embodiment, the centrifugal force acting on the laundry is balanced with gravity when the speed of the drum 10 is within the range of 70 to 80[rpm]. Accordingly, when the drum speed is 100[rpm], the laundry is pressed on the inner peripheral wall of the drum 10 and rotates with the drum.

In Step S16, when it is determined that the speed of the drum 10 is lower than 100[rpm], the central controller 31 determines whether a pulse signal from the speed detector 51 is detected within 0.5[sec] (Step S17). When it is determined in Step S17 that no pulse signal is detected for more than 0.5[sec], it is concluded that the drum 10 has stopped in the midrotation, so that the operation proceeds to Step S14 where the control angle α is further reduced by 50[μsec]. When, on the other hand, it is determined in Step S17 that a pulse signal is detected within 0.5[sec], the operation proceeds to Step S18 where the central controller 31 determines whether t1 is greater than 6[sec]. When t1 exceeds 6[sec] before the speed of the drum 10 attains 100[rpm], it is concluded that the torque is not adequately large, so that the operation proceeds to Step S14 where the control angle α is further reduced by 50[μsec].

When it is determined in Step S16 that the speed of the drum 10 is higher than 100[rpm], the control angle α at the moment is defined as the initial phase angle IK (Step S19). After that, the method of controlling the speed of the motor 16 is changed to a phase control method. That is, the central controller 31 gives an object speed Np of the motor 16 to the phase controller 32, and the phase controller 32 determines the control angle α based on the difference between the actual speed Nr and the object speed Np. Then, by the phase control method, the speed of the drum 10 is raised to 130[rpm] (Step S20). The laundry is pressed on the inner peripheral wall of the drum 10 and rotates with the drum 10 at that speed because the centrifugal force is greater than gravity. The eccentric load detector 33 detects the eccentric load based on the periodical change in the driving current supplied to the motor 16, as described above (Step S21).

After obtaining the magnitude and position of the eccentric load in Step S21, the central controller 31 determines whether the magnitude of the eccentric load is smaller than a preset value (Step S22). When it is determined in Step S22 that the magnitude of the eccentric load is smaller than the preset value, it is concluded that little or no vibration is expected to occur during the extracting operation with the current loading condition. Thus, the operation proceeds to Step S23 where the speed of the drum 10 is raised to a preset high speed of, for example, 1000[rpm].

When, on the other hand, it is determined in Step S22 that the magnitude of the eccentric load is greater than the preset value, a scattering operation is carried out as follows. First, in Step S24, a loosening operation is carried out, as in Step S10. After that, the driving current to the motor 16 is turned off for a preset time of 8[sec] for stopping the drum 10 completely (Step S25). The phase controller 32 sends the initial phase angle IK determined beforehand to the motor driving unit 40 as the control angle α, whereby a voltage corresponding to the phase angle IK is applied to the motor 16 (Step S26). At the same time, the central controller 31 start measuring the lapse of time (t2) by the timer (Step S27).

The central controller 31 determines whether a pulse signal from the speed detector 51 is detected within 1.5[sec] after the start of the time measurement (Step S28). When no pulse signal is detected, it is concluded that the motor 16 has stopped because the torque is not adequately large. Thus, the phase controller 32 reduces the control angle α by 50[μsec] (Step S30), and the initial phase angle IK is set at the new control angle α (Step S40). With the modified value of IK, the process of Steps S24 through S28 is carried out again. This time, the torque of the motor 16 is greater because the voltage applied to the motor 16 is higher.

In Step S28, when the pulse signal is detected within 1.5[sec], it is concluded that the motor 16 has not stopped. So, the central controller 31 determines whether the speed of the drum 10 is higher than 100[rpm] (Step S29). In Step S29, when the speed is not higher than 100[rpm], it is determined whether the lapse of time t2 is greater than 7[sec] (Step S31). When t2 is not greater than 7[sec], the operation returns to Step S28. When t2 exceeds 7[sec] before the speed of the drum 10 attains 100[rpm], it is concluded that the torque is not adequately large, so that the operation proceeds to Step 30 where the control angle α is further reduced by 50[μsec]. For example, when the laundry happens to be gathering at one of the baffles 10*b* after the start of the drum rotation, the time t2 may exceed 7[sec] before the speed of the drum 10 reaches 100[rpm] because it is difficult to dislodge the laundry beyond the baffle 10*b*.

In Step S29, the measurement of the time t2 is terminated when it is determined that the speed of the drum 10 is greater than 100[rpm], and the value t2 at the moment is stored in the memory (RAM) of the central controller 31 (Step S32). After that, the method of controlling the speed of the motor 16 is changed to the phase control method, and the speed is raised to 130[rpm], as in Step S20 (Step S33). After the speed attains 130[rpm], the eccentric load detector 33 detects the eccentric load, as in Step S21 (Step S34).

In Step S35, the central controller 31 determines whether the magnitude of the eccentric load is smaller than the preset value. When the magnitude of the eccentric load is smaller than the preset value, the speed of the drum 10 is raised to the high speed for extraction (Step S23). When, on the other hand, the magnitude of the eccentric load is greater than the preset value in Step S35, the central controller 31 reads out the time t2 from the RAM and determines whether t2 is smaller than 2.5[sec] (Step S36). When t2 is smaller than 2.5[sec], it is concluded that the torque for rotating the drum 10 is so large that the laundry cannot be scattered in a manner described later. Therefore, the control angle $\alpha$ is increased by 250[$\mu$sec] (Step S37), and the operation proceeds to Step S40.

In Step S36, when t2 is greater than 2.5[sec], it is determined whether t2 is smaller than 3[sec] (Step S38). When t2 is within the range of 2.5 to 3[sec], it is concluded that the torque for rotating the drum 10 is a little too large for the laundry to be adequately scattered.

Therefore, the control angle $\alpha$ is increased by 50[$\mu$sec] (Step S39), and the operation proceeds to Step S40. In Step S38, when t2 is greater than 3[sec], the operation proceeds to Step S40 without modifying the control angle $\alpha$.

By the above speed control method, the drum 10 starts rotating at a moderate rate of acceleration, and the speed of the drum 10 reaches 100[rpm] within several seconds. FIGS. 8A–8E and 9A–9D illustrate how the laundry moves in the drum 10 while the speed of the drum 10 is controlled as described above. FIGS. 8A–8E show the case where a plurality of small laundry articles are loaded in the drum 10, and FIGS. 9A–9D show the case where a single piece of large laundry article, such as a bed sheet, is loaded in the drum 10.

Figure 8A:
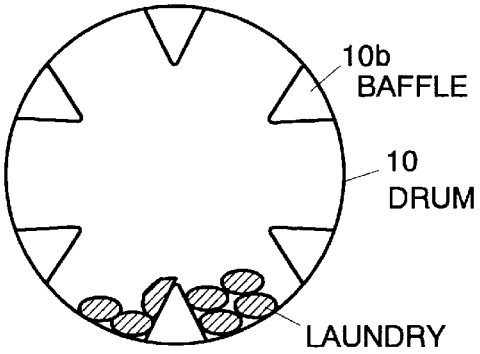
FIGS. 8A–8E, 9A–9D are illustrations showing the movement of the laundry in the drum.
Figure 8B:
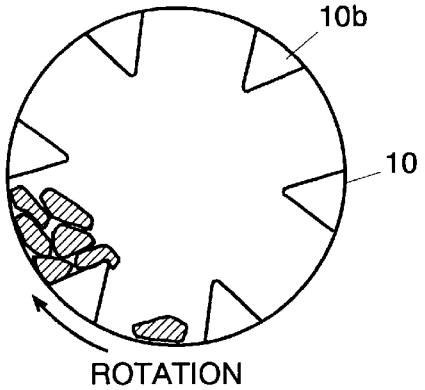
Figure 8C:
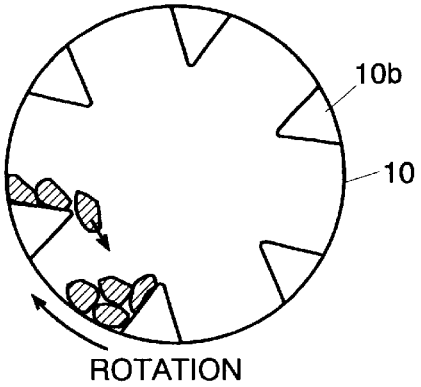
Figure 8D:
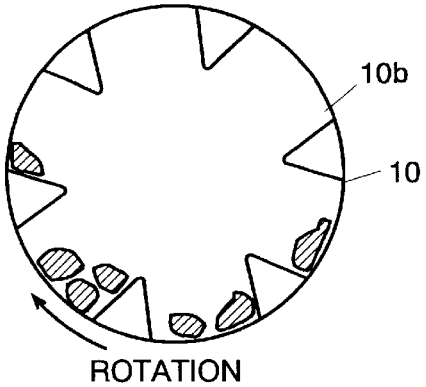

Referring to FIGS. 8A–8E, at first the laundry articles lie at the bottom of the drum 10 as shown in FIG. 8A. When the drum 10 starts rotating, the articles are lifted by the baffles 10*b* as shown in FIG. 8B. Then, some of the articles fall beyond the baffles 10*b* onto the bottom, as shown in FIG. 8C. Such a process is repeated while the drum 10 is rotating. When most of the articles are being lifted by the same baffle 10*b* as shown in FIG. 8B, the gravity acting on the articles works as a load against the rotation of the drum 10, so that a large torque is necessary to maintain the rotation of the drum 10. When, on the other hand, the drum 10 further rotates and some of the laundry falls off (or beyond) the baffle 10*b* as shown in FIG. 8C, the load caused by gravity decreases rapidly, and the torque necessary to maintain the rotation of the drum 10 becomes smaller.

Accordingly, when a constant voltage is applied to the motor 16 in the initial stage of the drum rotation, the drum 10 rotates at a low speed when the load is large as shown in FIG. 8A, and then the speed increases rapidly when the load becomes smaller as the laundry is loosened as shown in FIG. 8C. The speed of the drum 10 increases gradually as the laundry articles are scattered on the inner peripheral wall of the drum 10.

Figure 8E:
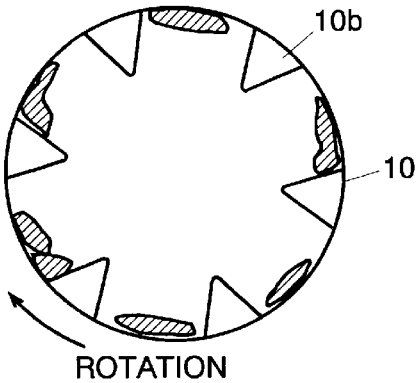

When the constant voltage applied to the motor 16 in the initial stage is determined appropriately, the mass of the laundry is loosened and the laundry articles are scattered on the inner peripheral wall of the drum 10 every time part of the laundry falls beyond the baffles 10*b* in the course of the rotation. When the load becomes adequately small, the speed of the drum 10 rapidly increases and reaches a speed where the centrifugal force acting on the laundry is greater than gravity. Thus, the scattered laundry is pressed on the inner peripheral wall of the drum 10 and rotates with the drum 10 as shown in FIG. 8E. When, on the other hand, the constant voltage applied to the motor 16 in the initial stage is too high, the speed of the drum 10 increases so rapidly that the drum 10 starts rotating with the laundry pressed on its inner peripheral wall as shown in FIG. 8B before the laundry is loosened adequately.

Hence, in the above embodiment, at first a control angle $\alpha$ that determines the initial voltage to be applied to the motor 16 (i.e. the initial phase angle IK) is determined by Steps S13 through S19, and the control angle $\alpha$ is modified by Step S26 and the subsequent steps taking account of the result of a test where the motor 16 is actually energized with the control angle $\alpha$. As a result of this modification process, an appropriate voltage to be applied to the motor 16 is determined. With this voltage being applied to the motor 16, the laundry is scattered properly in the drum 10 in the initial stage of the drum rotation.

Figure 9A:
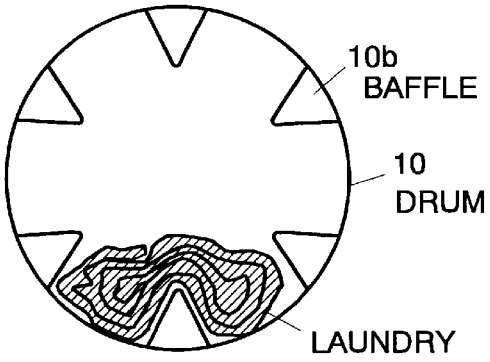
Figure 9B:
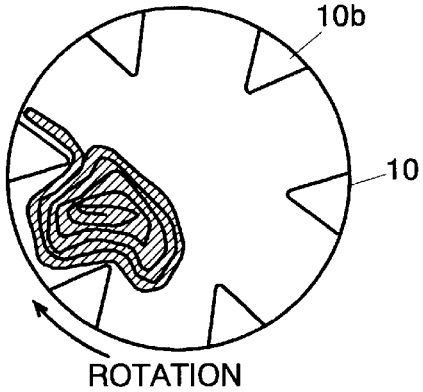
Figure 9C:
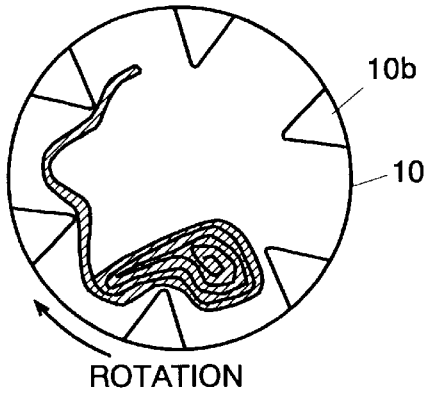
Figure 9D:
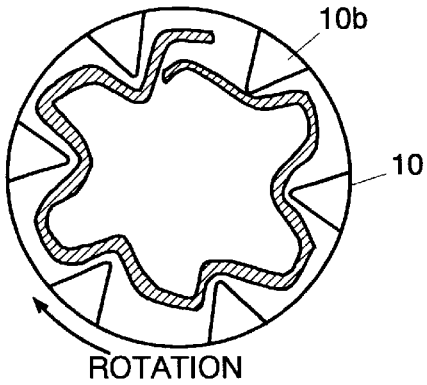

In the case where the laundry consists of a single piece of large article, at first the article lies at the bottom of the drum 10 as shown in FIG. 9A. As the rotation of the drum 10 proceeds, the article is gradually loosened every time it rolls beyond the baffle 10*b*, as shown in FIGS. 9B and 9C. When the load becomes adequately small, the speed of the drum 10 increases rapidly, so that the drum 10 starts rotating with the laundry spread out and pressed on the inner peripheral wall of the drum 10 by centrifugal force, as shown in FIG. 9D. Thus, the load balance around the rotation axis of the drum 10 is corrected, and the eccentric load is very small.

It should be noted that the above embodiment is a mere example, and the present invention is applicable not only to a drum type washing machine using water, but also to a dry cleaner using a petroleum detergent or other liquid material, for example.

What is claimed is:

1. A spin extractor for extracting liquid from a laundry by rotating a basket drum with the laundry loaded therein about a horizontal axis, comprising:

a motor for rotating the basket drum;

a speed detector for detecting a speed of the motor; and a speed controller for applying a constant voltage to the motor so that the basket drum is rotated at a constant torque and the laundry loaded in the basket drum is redistributed on an inner peripheral wall of the basket drum in an initial stage of a liquid extracting operation until a speed of the basket drum reaches a preset speed higher than an equilibrium speed at which a centrifugal force acting on the laundry in the basket drum is equal to gravity, and for controlling the motor so that an actual speed of the motor detected by the speed detector is maintained at an object speed after the speed of the basket drum reaches the preset speed.

2. A spin extractor for extracting liquid from a laundry by rotating a basket drum with the laundry loaded therein about a horizontal axis, comprising:

a motor for rotating the basket drum;

a speed detector for detecting a speed of the motor; and a speed controller for controlling the speed of the motor by a process comprising steps of:

applying a constant voltage to the motor so that the basket drum is rotated at a constant torque in an initial stage of a liquid extracting operation until a speed of the basket drum reaches a preset speed higher than an equilibrium speed at which a centrifugal force acting on the laundry in the basket drum is equal to gravity;

modifying the constant voltage when the constant torque is determined to be out of an appropriate range with respect to a load on the basket drum due to the laundry; and controlling the motor so that an actual speed of the motor detected by the speed detector is maintained at an object speed after the speed of the basket drum reaches the preset speed.

3. The spin extractor according to claim 2, further comprising:

an eccentric load detector for detecting a magnitude of an eccentric load due to an uneven distribution of the laundry based on a change in a driving current supplied to the motor while the basket drum is rotated at a speed higher than the equilibrium speed; and an eccentric load determiner for determining whether the magnitude of the eccentric load is greater than a preset value, and the speed controller is constituted to stop the basket drum temporarily and then to start rotating the basket drum again when the magnitude of the eccentric load is determined to be greater than the preset value.

4. The spin extractor according to claim 3, further comprising a timer for measuring a time period required for the speed of the basket drum to reach a preset speed when a first constant voltage is applied to the motor by the speed controller, and the speed controller is constituted to stop the basket drum temporarily and to start rotating the basket drum again by applying to the motor a second constant voltage lower than the first constant voltage when the time period required thereby is shorter than a preset time period.

5. The spin extractor according to claim 4, further comprising a lapse timer for measuring a lapse of time from a start of an application of the constant voltage to the motor, and the speed controller is constituted to increase the voltage applied to the motor when the lapse of time reaches a preset time period before the speed of the basket drum reaches a preset speed.

6. The spin extractor according to claim 4, wherein the speed controller is constituted to increase the voltage applied to the motor when the speed of the motor detected by the speed detector is zero while the constant voltage is applied to the motor.

7. The spin extractor according to claim 3, further comprising a lapse timer for measuring a lapse of time from a start of an application of the constant voltage to the motor, and the speed controller is constituted to increase the voltage applied to the motor when the lapse of time reaches a preset time period before the speed of the basket drum reaches a preset speed.

8. The spin extractor according to claim 3, wherein the speed controller is constituted to increase the voltage applied to the motor when the speed of the motor detected by the speed detector is zero while the constant voltage is applied to the motor.

9. The spin extractor according to claim 2, further comprising a timer for measuring a time period required for the speed of the basket drum to reach a preset speed when a first constant voltage is applied to the motor by the speed controller, and the speed controller is constituted to stop the basket drum temporarily and to start rotating the basket drum again by applying to the motor a second constant voltage lower than the first constant voltage when the time period required thereby is shorter than a preset time period.

10. The spin extractor according to claim 9, further comprising a lapse timer for measuring a lapse of time from a start of an application of the constant voltage to the motor, and the speed controller is constituted to increase the voltage applied to the motor when the lapse of time reaches a preset time period before the speed of the basket drum reaches a preset speed.

11. The spin extractor according to 9, wherein the speed controller is constituted to increase the voltage applied to the motor when the speed of the motor detected by the speed detector is zero while the constant voltage is applied to the motor.

12. The spin extractor according to claim 2, further comprising a lapse timer for measuring a lapse of time from a start of an application of the constant voltage to the motor, and the speed controller is constituted to increase the voltage applied to the motor when the lapse of time reaches a preset time period before the speed of the basket drum reaches a preset speed.

13. The spin extractor according to claim 12, wherein the speed controller is constituted to increase the voltage applied to the motor when the speed of the motor detected by the speed detector is zero while the constant voltage is applied to the motor.

14. The spin extractor according to claim 2, wherein the speed controller is constituted to increase the voltage applied to the motor when the speed of the motor detected by the speed detector is zero while the constant voltage is applied to the motor.

15. The spin extractor according to claim 2, wherein the speed controller is constituted to control the speed of the motor by a phase control process wherein a driving current supplied to the motor is an alternating current cut off at a timing corresponding to a control angle within each cycle of the alternating current and the speed of the motor is controlled by changing the control angle, the process including steps of maintaining the control angle until the speed of the basket drum reaches a preset speed and determining the control angle based on the difference between the actual speed and the object speed after the speed of the basket drum reaches the preset speed.

16. The spin extractor according to claim 2, wherein the speed controller is constituted to control the speed of the motor by a pulse width modulation process wherein a driving current supplied to the motor is in a form of a series of pulses each having a preset width and the speed of the motor is controlled by changing the pulse width, the process including steps of maintaining the pulse width until the speed of the basket drum reaches a preset speed and determining the pulse width based on the difference between the actual speed and the object speed after the speed of the basket drum reaches the preset speed.

17. The spin extractor according to claim 2, comprising at least six baffles provided on an inner peripheral wall of the basket drum at a preset angular interval.

* * * * *